US010253664B2

(12) United States Patent
Middleton, Jr. et al.

(10) Patent No.: US 10,253,664 B2
(45) Date of Patent: Apr. 9, 2019

(54) PASSIVE EXHAUST VALVE ASSEMBLY WITH OVERLAPPING SLIP JOINT AND METHOD OF FORMING AND INSTALLATION

(71) Applicant: Middleville Tool & Die Co., Middleville, MI (US)

(72) Inventors: Robert Leroy Middleton, Jr., Middleville, MI (US); Justin Tyler Middleton, Middleville, MI (US); Bradley Blair Walworth, Jackson, MI (US); Stephen M. Thomas, Laingsburg, MI (US); Larry Joseph Geer, Jackson, MI (US); Erwin Albert Peters, III, Cement City, MI (US)

(73) Assignee: Middleville Tool & Die Co., Middleville, MI (US)

( * ) Notice: Subject to any disclaimer, the term of this patent is extended or adjusted under 35 U.S.C. 154(b) by 0 days.

(21) Appl. No.: 15/346,204

(22) Filed: Nov. 8, 2016

(65) Prior Publication Data

US 2017/0204756 A1 Jul. 20, 2017

Related U.S. Application Data

(60) Provisional application No. 62/279,471, filed on Jan. 15, 2016.

(51) Int. Cl.
*F01N 1/16* (2006.01)
*F01N 1/18* (2006.01)
(Continued)

(52) U.S. Cl.
CPC ..... *F01N 1/166* (2013.01); *F01N 1/165* (2013.01); *F01N 1/20* (2013.01); *F02D 9/04* (2013.01);
(Continued)

(58) Field of Classification Search
CPC . F01N 1/165; F01N 1/166; F01N 1/18; F01N 1/20; F01N 2240/36;
(Continued)

(56) References Cited

U.S. PATENT DOCUMENTS 399,390 A 3/1889 Eareckson
1,242,621 A 10/1917 Watkins
(Continued)

FOREIGN PATENT DOCUMENTS

GB 187916 A 11/1922
GB 828929 A * 2/1960 ..... F16K 1/226

OTHER PUBLICATIONS

International Search Report of the International Searching Authority from corresponding Patent Cooperation Treaty (PCT) Application No. PCT/IB16/56727, indicated completed on Apr. 28, 2017.
(Continued)

*Primary Examiner* — Audrey K Bradley
(74) *Attorney, Agent, or Firm* — Gardner Linn

(57) ABSTRACT

A passive exhaust valve assembly includes an exhaust conduit that has a first pipe section attached in generally axial alignment with a second pipe section. The end portion of the first pipe section includes a circumferential segment disposed within the end portion of the second pipe section to form an overlapping interface. The end portions of the first and second pipe sections each include a flange protruding radially outward from the respective first or second pipe section, whereby the flanges engage with each other to form an axle seat therebetween. A support shaft extends laterally across an interior volume of the exhaust conduit and rotatably engages the axle seat. A valve plate is coupled to the support shaft within the interior volume of the exhaust conduit for moving relative to the exhaust conduit between open and closed positions.

17 Claims, 14 Drawing Sheets

(51) Int. Cl.
*F02D 9/10* (2006.01)
*F02D 9/04* (2006.01)
*F01N 1/20* (2006.01)

(52) U.S. Cl.
CPC ..... *F02D 9/10* (2013.01); *F02D 9/106* (2013.01); *F02D 9/107* (2013.01); *F02D 9/1015* (2013.01); *F02D 9/1045* (2013.01); *F01N 1/18* (2013.01); *F01N 2240/36* (2013.01); *F01N 2290/10* (2013.01)

(58) Field of Classification Search
CPC ..... F01N 2290/10; F02D 9/04; F02D 9/10; F02D 9/1015; F02D 9/1045; F02D 9/106; F02D 9/107
See application file for complete search history.

(56) References Cited

U.S. PATENT DOCUMENTS 1,422,466 A 7/1922 Morse
1,447,380 A 3/1923 Goetz
1,613,322 A 1/1927 Goetz
1,672,266 A 6/1928 Linendoll
2,936,778 A 5/1960 Stillwagon
3,234,924 A 2/1966 May
4,682,674 A 7/1987 Schmidt
4,699,244 A 10/1987 Bergquist et al.
4,944,325 A * 7/1990 Baldwin ..... F16K 27/0218 137/375
5,029,811 A * 7/1991 Yamamoto ..... F16K 27/0218 251/306
5,046,408 A 9/1991 Eugenio
5,305,787 A 4/1994 Thygesen
5,355,673 A 10/1994 Sterling et al.
5,979,871 A * 11/1999 Forbes ..... F02D 9/1045 123/337
6,338,246 B2 1/2002 Eguchi et al.
6,354,267 B1 * 3/2002 Kotchi ..... F02D 9/10 123/337
6,508,455 B2 * 1/2003 Rauch ..... F02D 9/1065 251/305
6,739,579 B1 5/2004 Rim
7,434,570 B2 10/2008 Hill
7,628,250 B2 12/2009 Abram et al.
7,775,322 B2 8/2010 Hill
7,896,130 B2 3/2011 Hill et al.
8,191,572 B2 6/2012 Lefler et al.
8,201,401 B2 6/2012 Abram et al.
8,215,103 B2 7/2012 Hill
8,371,522 B2 2/2013 Piesker
8,381,401 B2 2/2013 Sahs et al.
8,468,813 B2 6/2013 Hill et al.
8,657,065 B1 2/2014 Hill
8,776,508 B2 7/2014 Abram et al.
8,950,731 B2 2/2015 Ishihata et al.
9,464,559 B2 10/2016 Middleton, Jr. et al.
2006/0260868 A1 11/2006 Suzuki et al.
2007/0283680 A1 12/2007 Willats et al.
2008/0083218 A1 4/2008 Abram et al.
2008/0115494 A1 5/2008 Willats et al.
2009/0126358 A1 5/2009 Abram et al.
2009/0126359 A1 5/2009 Abram et al.
2010/0263211 A1 10/2010 Sahs et al.
2013/0233269 A1 9/2013 Houtschilt et al.
2013/0299004 A1 11/2013 Abram
2015/0027566 A1 1/2015 Kobori
2015/0159787 A1 6/2015 Abram et al.

OTHER PUBLICATIONS

Written Opinion of the International Searching Authority from corresponding Patent Cooperation Treaty (PCT) Application No. PCT/IB16/56727, indicated completed on Apr. 28, 2017.

* cited by examiner

PASSIVE EXHAUST VALVE ASSEMBLY WITH OVERLAPPING SLIP JOINT AND METHOD OF FORMING AND INSTALLATION

CROSS-REFERENCE TO RELATED APPLICATION

The present application claims benefit under 35 U.S.C. § 119(e) of U.S. Provisional Application Ser. No. 62/279,471, entitled PASSIVE EXHAUST VALVE ASSEMBLY WITH OVERLAPPING SLIP JOINT AND METHOD OF FORMING AND INSTALLATION, filed Jan. 15, 2016, which is hereby incorporated herein by reference in its entirety.

FIELD OF THE INVENTION

The present invention relates generally to the field of passive exhaust valves, and more particularly to spring biased valve plates assembled to pivot within an exhaust conduit and the corresponding methods of forming and installing such assemblies.

BACKGROUND OF THE INVENTION

To control back flow pressure and reduce low frequency engine noise in exhaust systems of combustion engines, it is generally understood that a passive valve may be provided in the exhaust line to alter characteristics of exhaust flow and to attenuate exhaust system noise by actuating in response to changes in exhaust pressure. Other known means for addressing these issues typically involve increasing exhaust system capacity and mass. Although passive valves can reduce exhaust system mass and weight, other potential issues with passive exhaust valve assemblies, such as valve noises, reliability, and manufacturing cost, have been deterrents to widespread adoption in combustion engine exhaust systems for vehicles.

SUMMARY OF THE PRESENT INVENTION

In accordance with one aspect of the present invention, a passive exhaust valve assembly includes an exhaust conduit having a first pipe section attached to a second pipe section with the first pipe section mated partially within the second pipe section to form an overlapping interface between end portions of the first and second pipe sections. The end portions of the first and second pipe sections each include an outward protruding flange that interrupts a circumferential segment of the overlapping interface. The outward protruding flanges align with each other to form an axle seat, whereby a support shaft extends laterally across an interior volume of the exhaust conduit and rotatably engages the axle seat. A valve plate is coupled to the support shaft within the interior volume of the exhaust conduit for operating the valve plate between open and closed positions.

Optionally, an interior surface of the first or second pipe section may include a recessed pocket that protrudes radially outward for containing a flexible bumper element, such as a metal mesh pad and/or a resilient leaf spring, arranged to contact the valve plate and dissipate impact of the valve plate moving toward the closed position. The end portion of the opposing pipe section without the recessed pocket may also include a tab that extends longitudinally to overlap with the recessed pocket and support the flexible bumper element in the recessed pocket, such as with a pair of arm portions or members that extend longitudinally to the recessed pocket to supporting edge portions of a flexible bumper element in a manner that allows movement of the flexible bumper element when resiliently flexing upon contact with valve plate.

In accordance with another aspect of the present invention, a method of assembling of a passive exhaust valve assembly includes selecting a first pipe section having an end portion with a first diameter and a second pipe section having an end portion with a second diameter, where the end portion of first pipe section is sized to mate by fitting at least partially within the end portion of the second pipe. An outward protruding flange may then be formed about the circumference at each end portion of the first and second pipe sections. A first seat portion and a second seat portion may be formed on the outward protruding flanges of the respective first and second pipe sections, such that, upon attaching the pipe sections together, alignment of the first and second seat portions form an axle seat. A circumferential section of each of the outward protruding flanges adjacent to the respective seat portion may then be bent or formed back to or near the respective original diameter of the first or second pipe section. A support shaft with a valve plate fixed to an intermediate portion of the support shaft may then be placed in one of the seat portions. The smaller diameter pipe section is then inserted within the other pipe section with the seat portions aligned to form the axle seat around the support shaft and to define an overlapping interface between the end portions of the first and second pipe sections. The overlapping interface may then be welded to attach the first pipe section to the second pipe section and form an exhaust conduit of a valve assembly.

In accordance with yet another aspect of the present invention, a method of assembling a passive exhaust valve assembly may include cutting an edge portion away from the first and second metal blanks to define a cutout area. A first seat portion may be formed at an edge of the cutout area of the first metal blank, and a second seat portion may similarly be formed at an edge of the cutout area of the second metal blank. The first metal blank may then be stamped into a tubular shape and the tubular shaped piece may be stamped with a plurality of successive dies to form a first pipe section with the first seat at an end thereof. Likewise, the second metal blank may be stamped to form a second pipe section with the second seat at an end thereof. A support shaft may then be placed in one of the first and second seat portions, where the support shaft includes a valve plate fixed to an intermediate portion of the support shaft. An end portion of the first pipe section may then be inserted within the second pipe section with the first seat portion aligned with the second seat portion to form axle seat around the support shaft. The end portion of the second pipe section overlaps the first pipe section to define an overlapping interface, which may be welded to attach the first and second pipe sections together to form an exhaust conduit.

Optionally, the overlapping interface may include an exterior surface of the first pipe section abutting an interior surface of the second pipe section, such as at the circumferential sections of the first and second pipe sections that are each bent back to the original diameter. Also, a recessed pocket may optionally be formed on an interior surface of the first or second pipe section that protrudes radially outward from an exhaust flow path that extends axially through the exhaust conduit. A flexible bumper element, such as a metal mesh pad and/or a resilient leaf spring, may optionally be placed in the recessed pocket on an interior surface of the second pipe section in a location arranged to contact the valve plate and dissipate impact of the valve plate moving toward a closed position. Further, a tab may optionally be formed at the end portion of one of the pipe sections that extends longitudinally inside the other pipe section to overlap with the recessed pocket on an interior of the other pipe section, whereby the tab supports a flexible bumper element in the recessed pocket. Such a tab may include a pair of arms or members that extend longitudinally to the recessed pocket on the interior of the other pipe section, where the pair of arms may support edge portions of a flexible bumper element disposed in the recessed pocket in a manner that allows sliding movement of the flexible bumper element at the edge portions when resiliently flexing into the recessed pocket upon contact with valve plate.

These and other objects, advantages, purposes, and features of the present invention will become apparent upon review of the following specification in conjunction with the drawings.

DETAILED DESCRIPTION OF EMBODIMENTS

Figure 1:
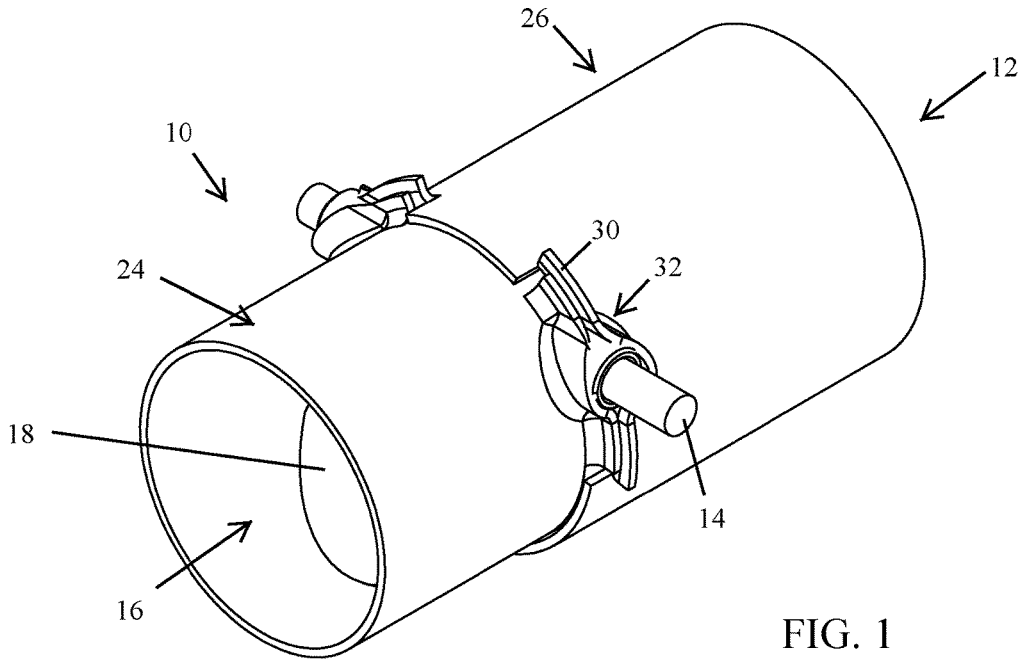
FIG. 1 is an upper perspective view of a passive exhaust valve assembly, in accordance with one embodiment of the present invention.
Figure 1A:
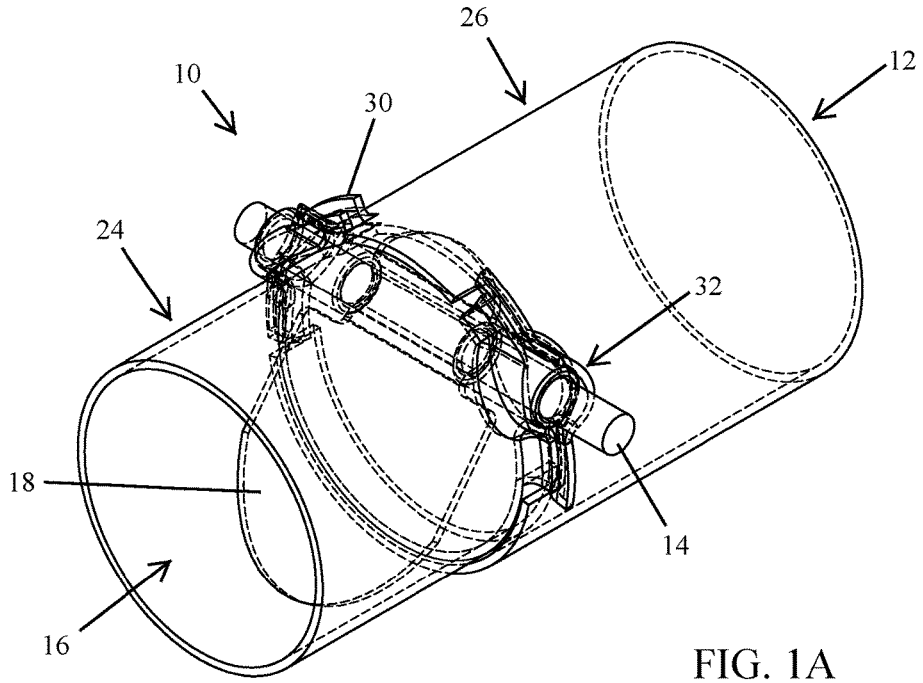
FIG. 1A is an upper perspective view of the passive exhaust valve assembly shown in FIG. 1, illustrating otherwise hidden portions and components in dashed lines.

Referring now to the drawings and the illustrative embodiments depicted therein, a passive exhaust valve assembly 10, 110 includes an exhaust conduit 12, 112, such as tube or pipe, that has a support shaft or axle 14, 114 extending laterally across an interior portion or volume 16, 116 of the of the exhaust conduit 12, 112 for supporting a vane or valve plate 18, 118 or the like. The valve plate 18, 118 is attached or coupled with the support shaft 14, 114 to pivot within the interior volume 16, 116 of the exhaust conduit 12, 112 between an open position 120 (FIG. 19) and a closed position 22, 122 (FIGS. 2 and 11) to regulate the flow of exhaust gases through the exhaust conduit 12, 112. The valve plate 18, 118 may be biased to the closed position 22, 112 and pivot toward the open position 20 when the flow of exhaust gas generates enough pressure to overcome the biasing force. To install or assemble the valve plate 18, 118 and support shaft 14, 114 in a pivotal manner relative to the exhaust conduit 12, 112, the exhaust conduit 12, 112 may be divided into a first pipe section 24, 124 and a second pipe section 26, 126 that are attached to form an overlapping interface or slip joint around the support shaft 14, 114. Such a slip-joint arrangement may allow the valve plate 18, 118 to be welded or otherwise attached to the support shaft 14, 114 outside the conduit 12, 112 prior to assembly, and may optionally allow for a flexible bumper element 142, such as shown in the embodiment illustrated in FIGS. 9-23, to be attached or otherwise disposed at an interior surface of the exhaust conduit 112 in a location that contacts the valve plate 118 and dissipates impact of the valve plate 118 moving toward the closed position.

Figure 2:
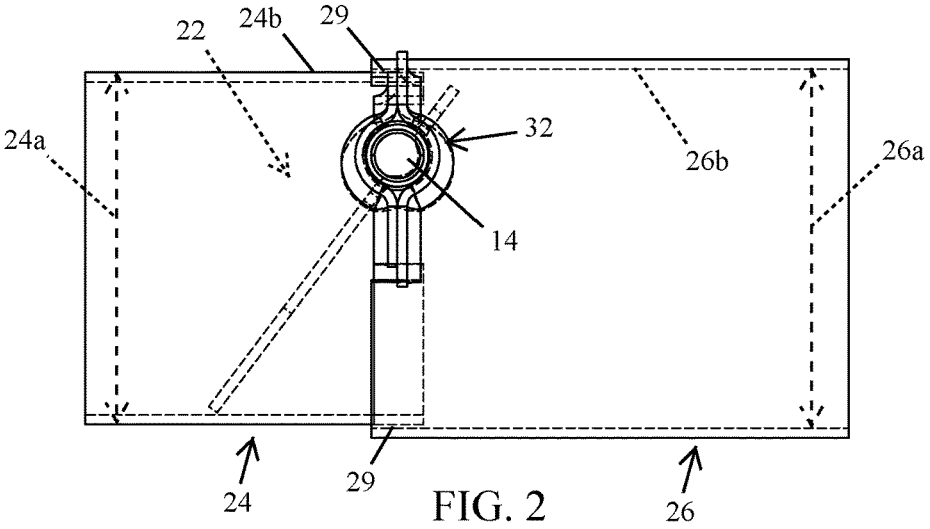
FIG. 2 is a side elevational view of the passive exhaust valve assembly shown in FIG. 1A.
Figure 3:
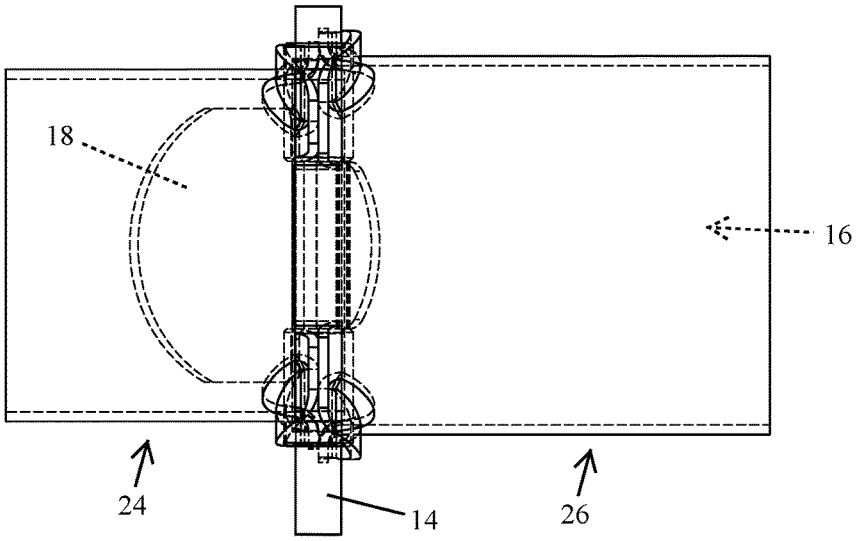
FIG. 3 is a top plan view of the passive exhaust valve assembly shown in FIG. 1A.

To form such an overlapping joint, one of the pipe sections (such as the first pipe section 24, 124) may be mated partially within the other pipe section (such as the second pipe section 26, 126) to form an overlapping interface 29 (FIG. 2) between end portions of the pipe sections 24, 26. As shown in FIG. 2, the first pipe section 24 has an exterior diameter 24*a* at its end portion that is less than or substantially equal to the interior diameter 26*a* of the second pipe section 26 at its end portion. It is contemplated that conversely the second pipe section may mate within the first pipe section in an additional embodiment. Also, it is conceivable that the diameter of the pipe sections may have different diameters at the central or intermediate portions that is different from the end portions, such that the end portions may be tapered or flared in other embodiments. Further, the end portions of the illustrated pipe sections 24, 26 are cut generally perpendicular to the longitudinal extent of the pipe section, although it is conceivable that the end portions of the pipe sections may be cut at an angle to provide more or less material on the upper or lower interior surfaces, such as to form alternatively configured recesses for a bumper element or alternatively configured tabs that extend to hold the bumper element in the recess.

Figure 4:
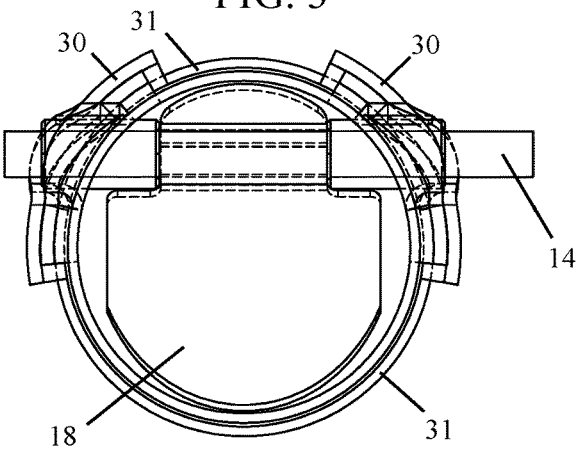
FIG. 4 is an end elevational view of the passive exhaust valve assembly shown in FIG. 1A.
Figure 5:
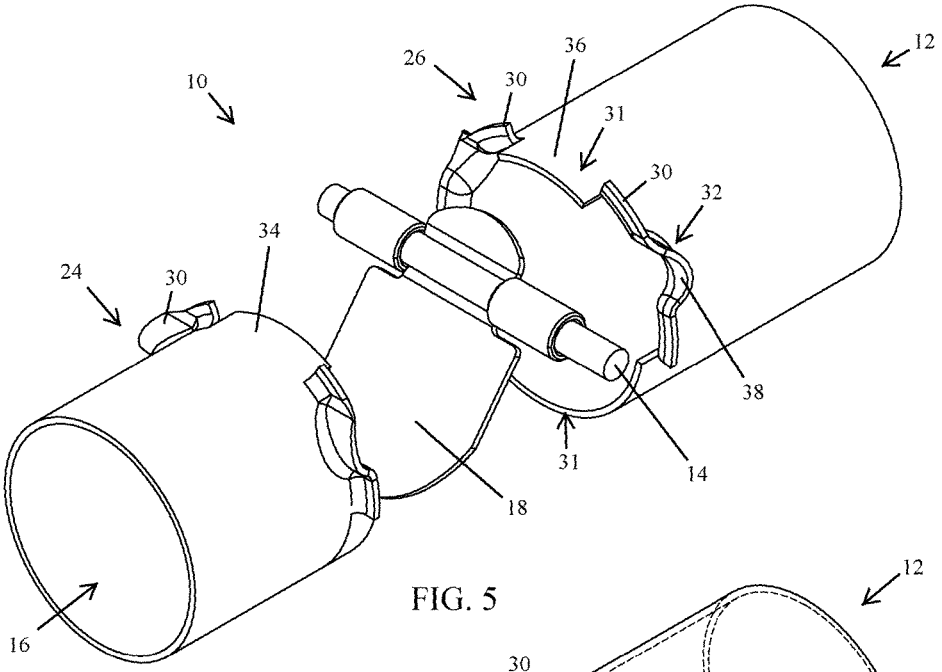
FIG. 5 is an exploded upper perspective view of the passive exhaust valve assembly shown in FIG. 1.
Figure 5A:
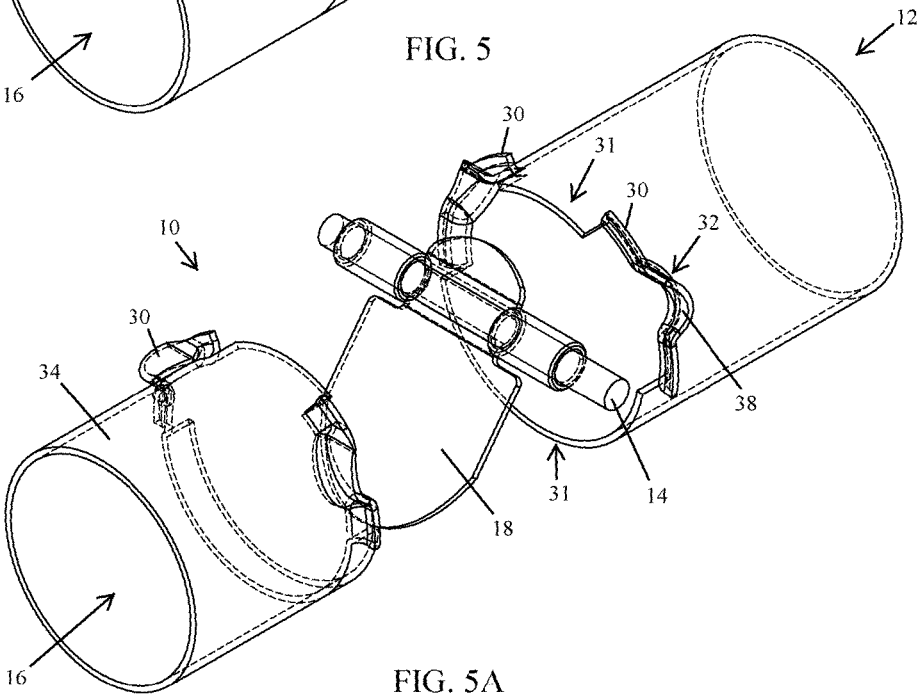
FIG. 5A is an exploded upper perspective view of the passive exhaust valve assembly shown in FIG. 1A.
Figure 5B:
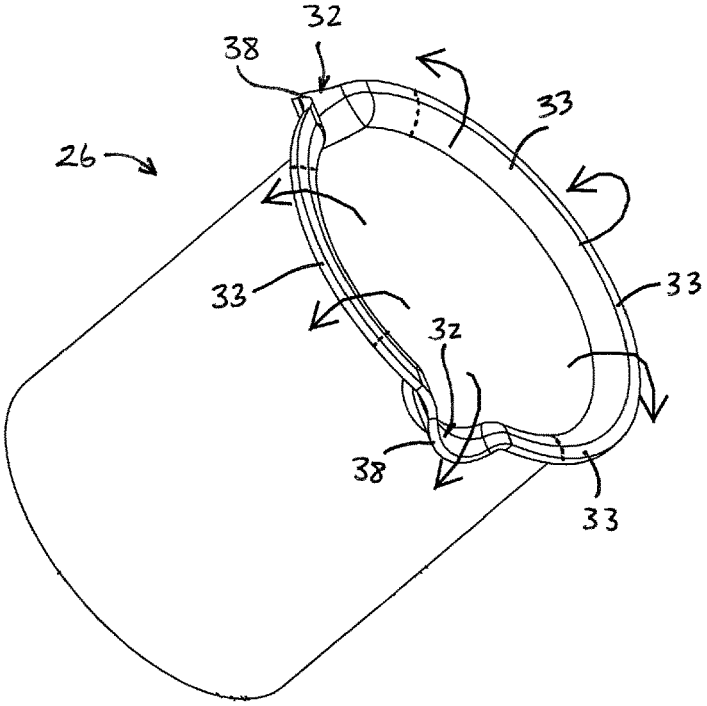
FIG. 5B is an upper perspective view of one of the pipe sections of the passive exhaust valve assembly shown in FIG. 5, shown prior to a final forming step.
Figure 5C:
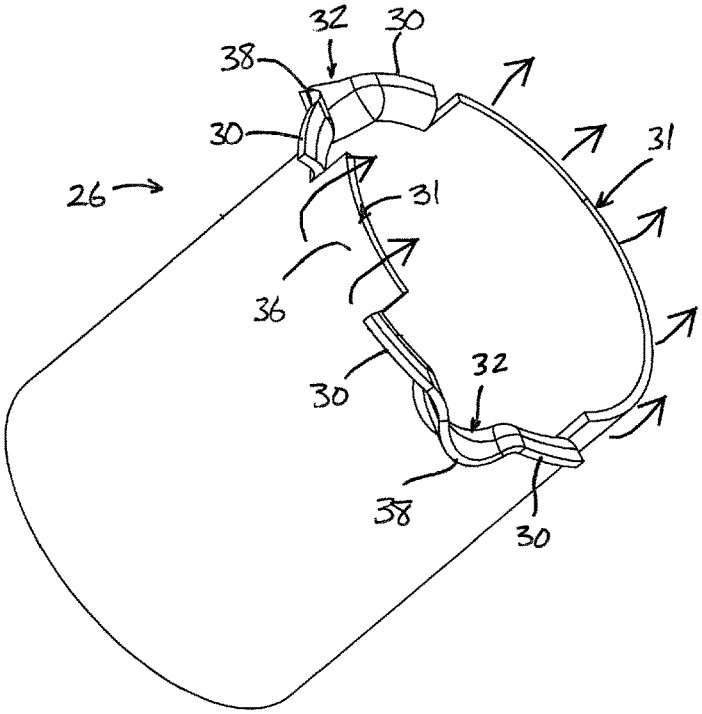
FIG. 5C is another upper perspective view of one of the pipe sections of the passive exhaust valve assembly shown in FIG. 5, and demonstrating a final forming step.
Figure 6:
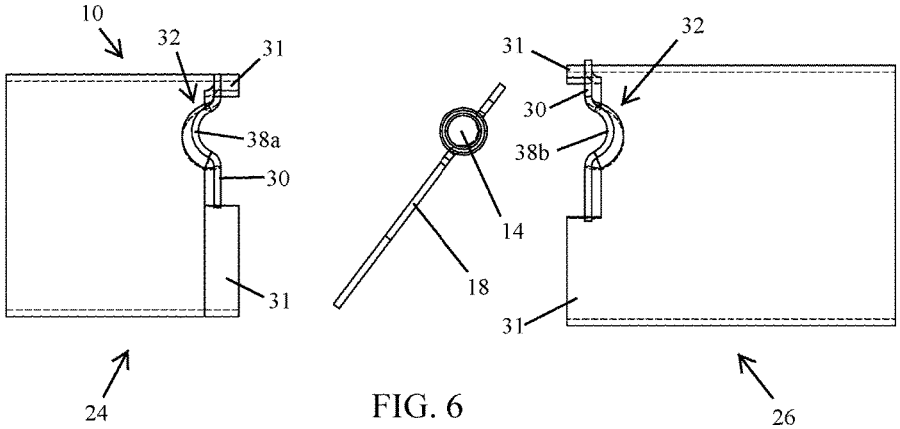
FIG. 6 is a side elevational view of the exploded passive exhaust valve assembly shown in FIG. 5A.
Figure 7:
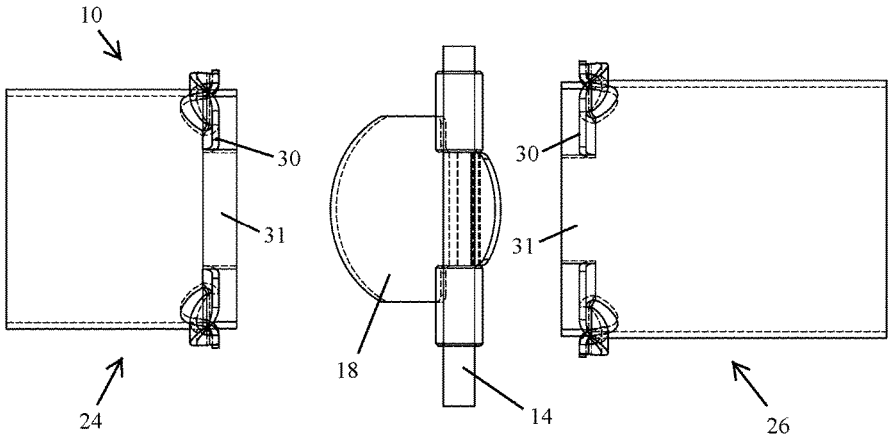
FIG. 7 is a top plan view of the exploded passive exhaust valve assembly shown in FIG. 5A.
Figure 8:
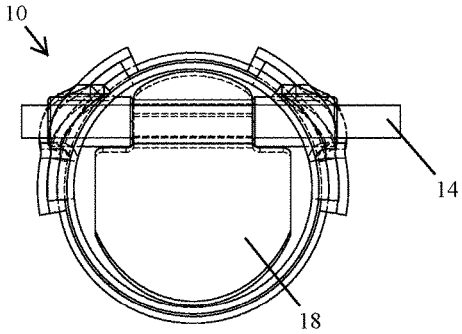
FIG. 8 is an end elevational view of the exploded passive exhaust valve assembly shown in FIG. 5A.
Figure 9:
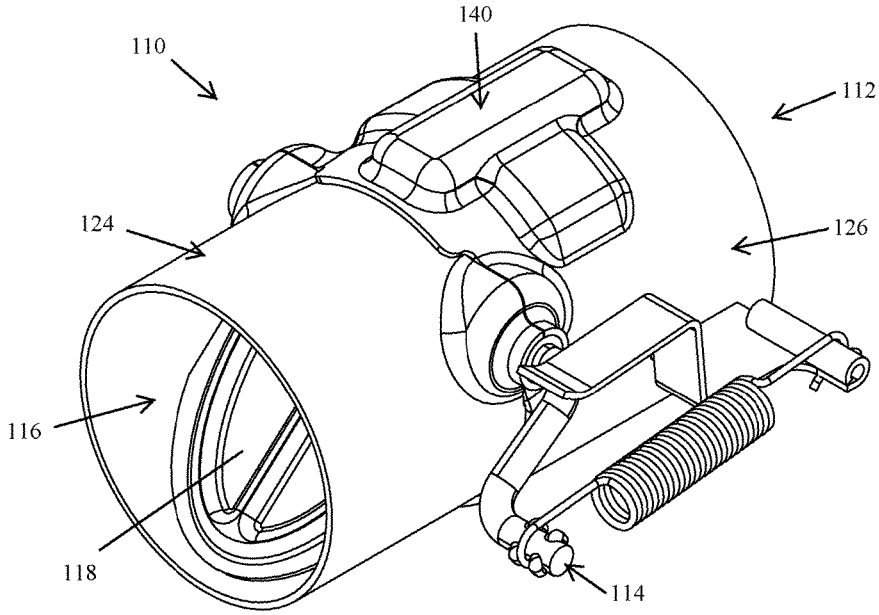
FIG. 9 is an upper perspective view of a passive exhaust valve assembly, in accordance with another embodiment of the present invention.
Figure 9A:
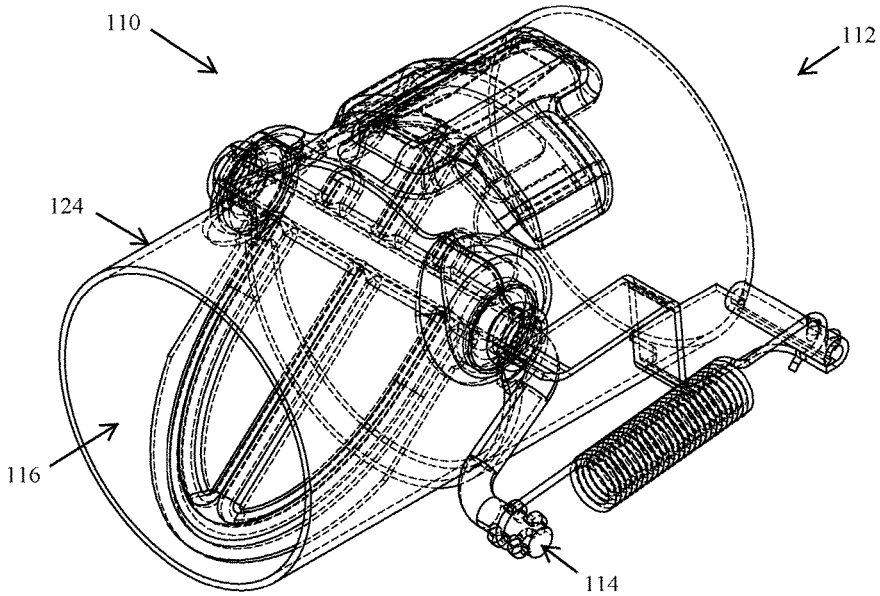
FIG. 9A is an upper perspective view of the passive exhaust valve assembly shown in FIG. 9, illustrating otherwise hidden portions and components in dashed lines.
Figure 10:
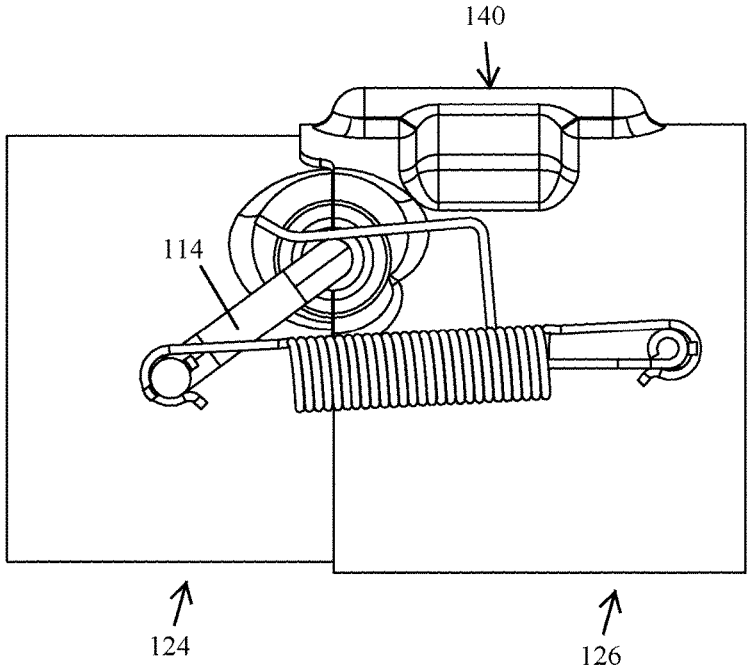
FIG. 10 is a side elevational view of the passive exhaust valve assembly shown in FIG. 9.

As illustrated, for example, in FIGS. 5-7, the end portions of the first and second pipe sections 24, 26 each include two outward protruding flanges 30. The flanges 30, as shown in FIGS. 4 and 5C, interrupt and protrude outward from corresponding circumferential segments 31 or arcs of the overlapping interface 29 (FIG. 2) at the end portions of the pipe sections 24, 26. The illustrated outward protruding flanges 30 align with each other to form the axle seats 32 (FIG. 2) on generally opposing sides of the exhaust conduit 12 for rotatably engaging the shaft 14. It is contemplated that each pipe section may have a single flange, such as a flange that extends along a larger segment of the circumference and interconnects between the axle seats. The support shaft 14 extends laterally across an interior volume of the exhaust conduit to support and position the valve plate within the interior volume 16 of the exhaust conduit 12 for pivoting the valve plate 18 between the open and closed positions 120, 22.

The end portions of the pipe sections 24, 26 that form the overlapping interface 29, such as shown in FIG. 2, have an outer surface 24*b* of the first pipe section 24 abutting an inner surface 26*b* of the second pipe section 26, whereby the edges of the pipe sections 24, 26 provide a generally consistent weld condition, which may also be referred to as a lap weld joint. The overlapping interface 29 between the pipe sections 24, 26 are thereby formed by the portion 34 of the outer circumferential surface of the first pipe section 24 that is overlapped by the portion 36 of the inner circumferential surface of the second pipe section 26. These overlapping surfaces may be in substantially continuous abutting contact, and optionally may be attached by various forms of welding, high temperature adhesives, induction shrink fitting, or fasteners or the like.

The outward protruding flanges 30 are shown spaced longitudinally away from the end edges of the overlapping interface 29, such that the portions of the pipe sections 24, 26 that form the overlapping interface 29 may define longitudinal projections that generally maintain the circular curvature of the pipe section. For example, as shown in FIGS. 5 and 5C, the end portions of the pipe sections 24, 26 each have upper and lower longitudinal projections, shown as circumferential segments 31, which are provided to form the overlapping interface 29. The illustrated lower longitudinal projection extends along a greater extent of the circumference than the upper longitudinal projection, such that the axle seats 32 are arranged to position the support shaft 14 at an offset location relative to the central axis of the exhaust conduit 12. It is contemplated that the upper and lower longitudinal projections in additional embodiments may instead be substantially equal in circumferential length to position the support shaft centrally across a diameter of the exhaust conduit, thereby generally intersecting the central axis.

The outward protruding flanges 30, circumferential segments 31, and axle seats 32 may be formed by a method that begins with a tubular blank. Referring to FIG. 5B, the tubular blank is first formed with a continuous flange 33 around the circumference of the end portion of the pipe section, as indicated with curved arrows in FIG. 5B, which flange 33 may include axle seats 32 as shown. The continuous flange 33 is then cut on opposite sides of the axle seats 32, such as indicated with dotted lines in FIG. 5B. After these cuts are made along the flange 33, the circumferential segments 31 are formed by bending their portions of the flange 33 back to or near a diameter in substantial alignment with a longitudinal extent of a main tubular shaped portion of the respective pipe section, such as indicated with curved arrows in FIG. 5C. The flanges 30 and axle seats 32 remain protruding radially outward generally orthogonal to the circumferential segments 31. The respective circumferential segments 31 of the first and second pipe sections 24, 26 engage to form the overlapping interface.

The outward protruding flanges 30 may also include an indentation 38 or seat portion formed on the surface of each flange 30 to abut together and form the axle seat 38, as shown in FIG. 2. As further shown in FIG. 6, a first seat portion 38*a* is formed on the outward protruding flanges 30 of the first pipe section 24 and a second seat portion 38*b* is formed on the outward protruding flanges 30 of the second pipe section 24, such that upon alignment the first and second seat portions 38*a*, 38*b*, the axle seat 38 is formed with a diameter that allows the axle seat 38 to engage substantially around the circumference of the support shaft 14.

Figure 11:
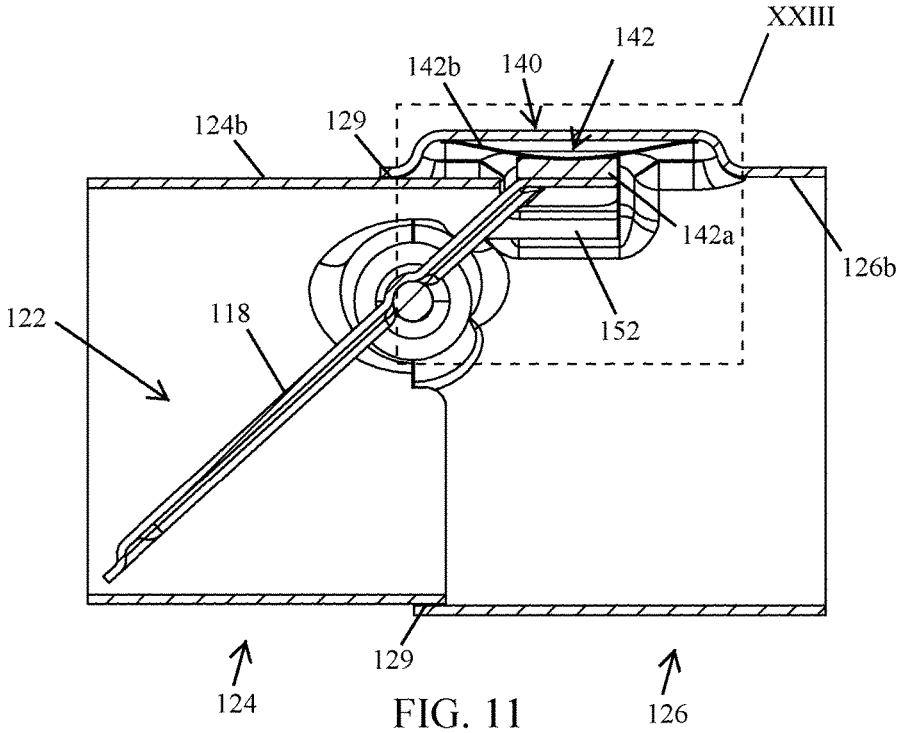
FIG. 11 is a cross-sectional view of the passive exhaust valve assembly shown in FIG. 9, taken at line XI-XI of FIG. 12.
Figure 12:
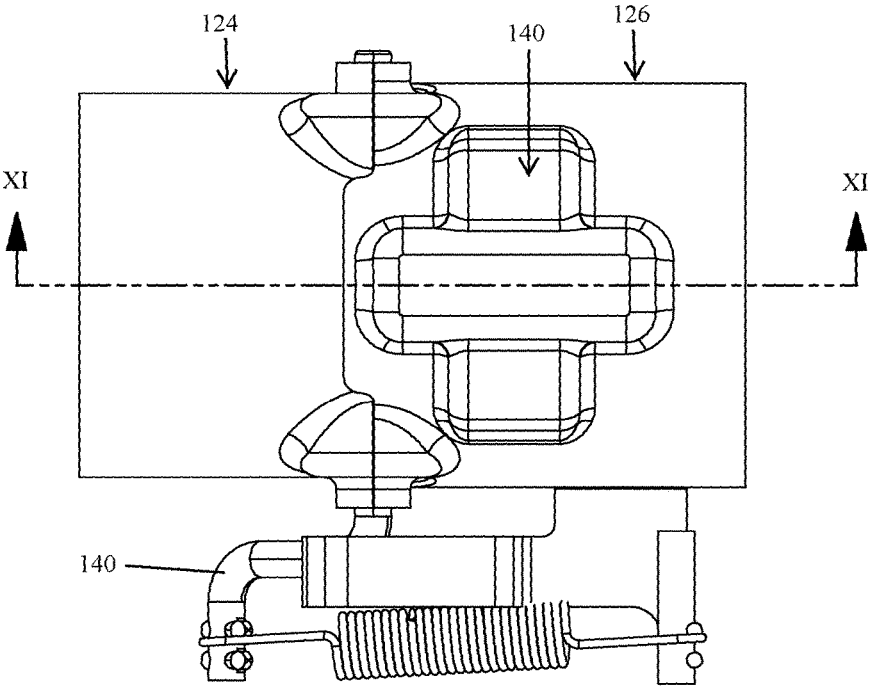
FIG. 12 is a top plan view of the passive exhaust valve assembly shown in FIG. 9.
Figure 13:
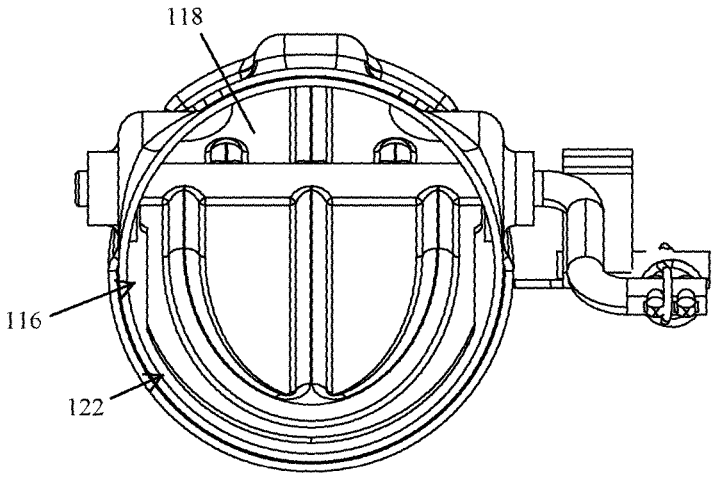
FIG. 13 is an end elevational view of the passive exhaust valve assembly shown in FIG. 9.
Figure 14:
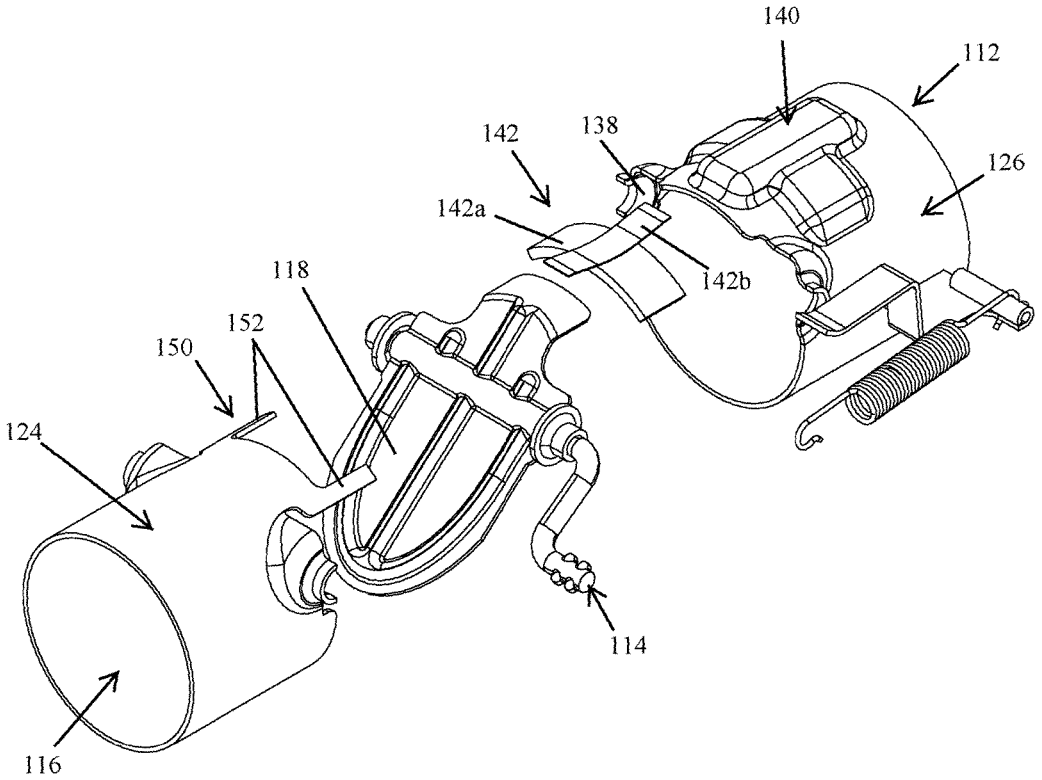
FIG. 14 is an exploded upper perspective view of the passive exhaust valve assembly shown in FIG. 9.
Figure 15:
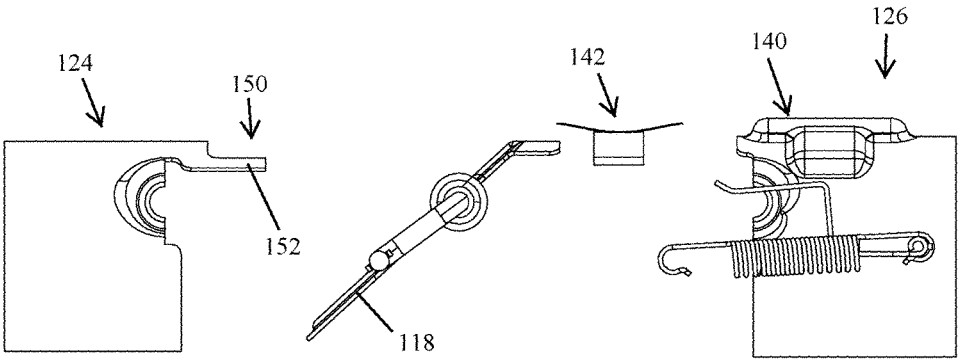
FIG. 15 is a side elevational view of the exploded passive exhaust valve assembly shown in FIG. 14.
Figure 16:
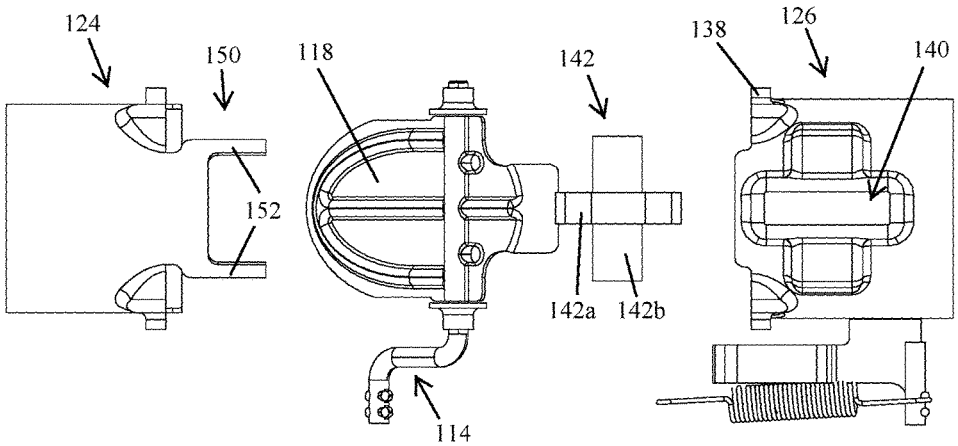
FIG. 16 is a top plan view of the exploded passive exhaust valve assembly shown in FIG. 14.
Figure 17:
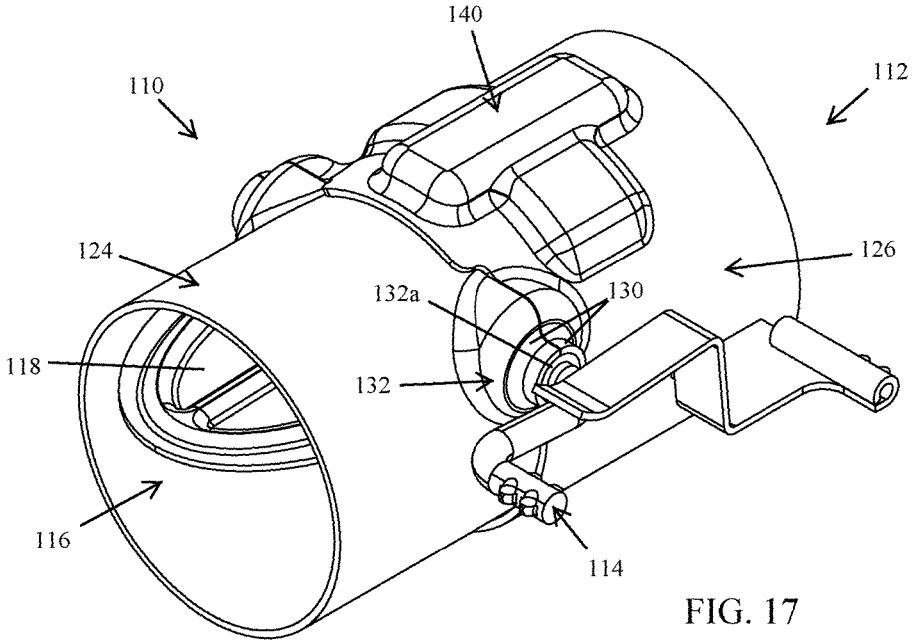
FIG. 17 is an upper perspective view of the passive exhaust valve assembly shown in FIG. 9, illustrating a valve plate in an open position.
Figure 17A:
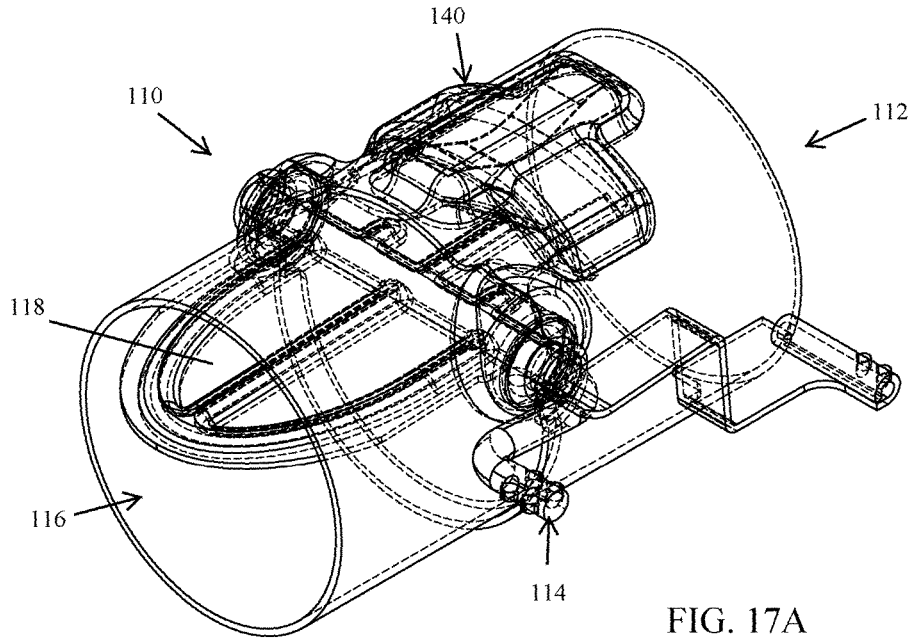
FIG. 17A is an upper perspective view of the passive exhaust valve assembly shown in FIG. 17, illustrating otherwise hidden portions and components in dashed lines.
Figure 18:
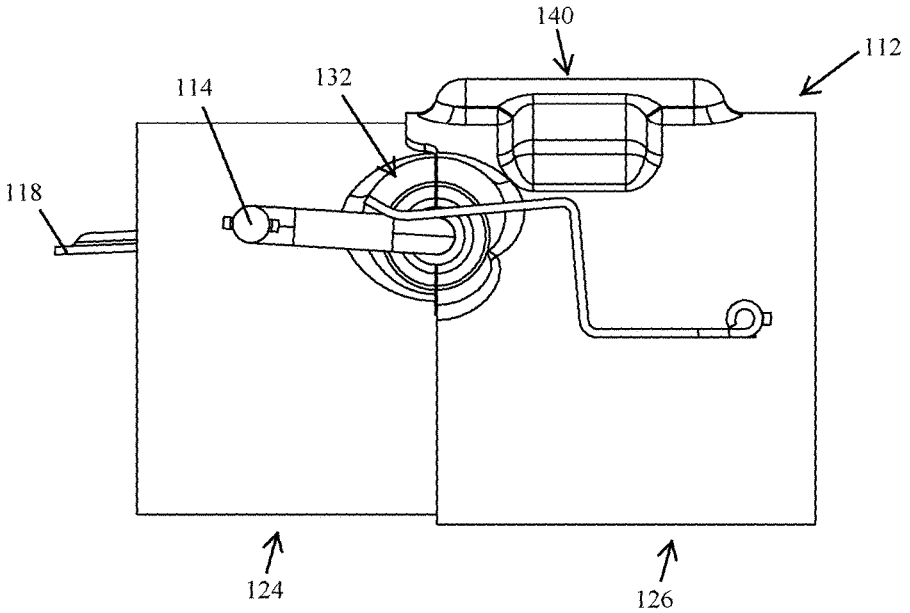
FIG. 18 is a side elevational view of the passive exhaust valve assembly shown in FIG. 17.

As shown in FIGS. 9-23, an additional embodiment of the exhaust valve assembly 110 provides a recessed pocket 140 (FIG. 11) or containment area that is disposed at an interior surface of the second pipe section 126 and protrudes radially outward for containing a flexible bumper element 142, such as shown in FIG. 14 as a metal mesh pad 142*a* and a resilient leaf spring 142*b*. The leaf spring 142*b* is positioned between the interior surface of the recessed pocket 140 and the metal mesh pad 142*a*, such that the mesh pad 142*a* is arranged to contact the valve plate 118, such as shown in FIG. 11, and dissipate impact of the valve plate 118 moving toward the closed position 122. The end portion of the pipe section 124 without the recessed pocket may also include a tab 150 (FIG. 14) that extends longitudinally to overlap with the recessed pocket 140 and support the flexible bumper element 142 in the recessed pocket 140. As also shown in FIGS. 11-23, such a tab 150 (FIG. 14) is provided with a pair of arm portions 152 or members that extend longitudinally to the recessed pocket 140 to supporting edge portions of a flexible bumper element 142*a* in a manner that allows movement of the flexible bumper element 142*a* when resiliently flexing upon contact with valve plate 118. With the bumper element 142*a* in this recessed location, as shown in FIG. 11, an end portion of the valve plate 118 contacts the bumper element 142*a* in or moving toward the closed position 122 to reduce noise generated by the valve plate 118 reaching the closed position 122 which without the bumper element may otherwise cause the valve plate or other part that pivots with the valve plate to abruptly contact a rigid surface when reaching the closed position and thereby cause an undesirable sound.

In accordance with another aspect of the present invention, a method of assembling of a passive exhaust valve assembly 10, 110 includes selecting a first pipe section having an end portion with a first diameter and a second pipe section having an end portion with a second diameter, where the end portion of first pipe section is sized to mate by fitting at least partially within the end portion of the second pipe. An outward protruding flange 33 may then be formed about the circumference at each end portion of the first and second pipe sections, such as shown in FIG. 5B. A first seat portion and a second seat portion may be formed on the outward protruding flanges of the respective first and second pipe sections, such that upon mating and alignment of the first and second seat portions, an axle seat is generally formed. A circumferential section or segment 31 of each of the outward protruding flanges 33 adjacent to the respective seat portion may then be bent or formed back to or near the respective original diameter of the first or second pipe section, such as shown in FIG. 5C. A support shaft with a valve plate fixed to an intermediate portion of the support shaft may then be placed in one of the seat portions. The smaller diameter pipe section is then inserted within the other pipe section with the seat portions aligned to form the axle seat around the support shaft and to define an overlapping interface between the end portions of the first and second pipe sections. The overlapping interface may then be welded to attach the first pipe section to the second pipe section and form an exhaust conduit of a valve assembly.

In accordance with yet another aspect of the present invention, a method of assembling of a passive exhaust valve assembly includes providing first and second metal blanks, whereby an edge portion is cut from the first and second metal blanks to define a cutout area. A first seat portion may be formed at an edge of the cutout area of the first metal blank, and a second seat portion may similarly be formed at an edge of the cutout area of the second metal blank. The first metal blank may then be stamped into a tubular form and the tubular form may be stamped with a plurality of successive dies to form a first pipe section with the first seat at an end thereof. Likewise, the second metal blank may be stamped to form a second pipe section with the second seat at an end thereof. A support shaft may then be placed in one of the first and second seat portions, where the support shaft includes a valve plate fixed to an intermediate portion of the support shaft. An end portion of the first pipe section may then be inserted within the second pipe section with the first seat portion and aligned with the second seat portion to form an axle seat around the support shaft. The end portion of the second pipe section overlaps the first pipe section to define an overlapping interface, which may be welded to attach the first and second pipe sections together to an exhaust conduit.

Optionally, the overlapping interface may include an exterior surface of the first pipe section abutting an interior surface of the second pipe section, such as at the circumferential sections of the first and second pipe sections that are bent back to the original diameters. Also, a recessed pocket may optionally be formed on an interior surface of the first or second pipe section that protrudes radially outward from an exhaust flow path that extends axially through the exhaust conduit. A flexible bumper element, such as a metal mesh pad and/or a resilient leaf spring, may optionally be placed in a recessed pocket on an interior surface of the second pipe section in a location arranged to contact the valve plate and dissipate impact of the valve plate moving toward a closed position. Further, a tab may optionally be formed at the end portion of one of the pipe sections that extends longitudinally inside the other pipe section to overlap with a recessed pocket on an interior of the other pipe section, whereby the tab supports a flexible bumper element in the recessed pocket. Such a tab may include a pair of arms or members that extend longitudinally to a recessed pocket on an interior of the other pipe section, where the pair of arms may support edge portions of a flexible bumper element disposed in the recessed pocket in a manner that allows sliding movement of the flexible bumper element at the edge portions when resiliently flexing into the recessed pocket upon contact with valve plate.

The exhaust conduit of the passive exhaust valve assembly may include an inlet end and an outlet end on opposing ends of the exhaust conduit to respectively receive and dispense exhaust gases longitudinally though the exhaust conduit. The exhaust conduit may have an elongated tube or pipe shape with a curved exterior surface and a similarly curved interior surface. The interior section or volume of the exhaust conduit may thereby define a flow path along the longitudinal, central axis of the exhaust conduit, which extends generally through the internal section or volume of the exhaust conduit between the inlet and outlet ends. The valve plate may be positioned within the flow path of the internal volume and pivoted to the closed position for generally preventing exhaust gases from transferring through the tubular conduit. Although illustrated in FIGS. 1-23 as a tubular shape, it is conceivable that the exhaust conduit in additional embodiments may have a different cross-sectional shape and may be curved or otherwise non-linear in the longitudinal direction.

The valve plate may be operably coupled within the interior section of the exhaust conduit and pivotal about a pivot axis between the open position, where the body portion of the valve plate is generally parallel with the exhaust flow path to provide a minimized resistance to the exhaust flow, and the closed position, where the body portion of the valve plate is at an angle that substantially reduces flow of exhaust gases through the exhaust conduit to provide a maximized resistance to the exhaust flow. The body portion of the valve plate may be rigidly coupled, such as by welding, with a support shaft or axle that defines the pivotal axis of the valve plate. The pivotal axis is generally perpendicular relative to the exhaust flow path, and, as shown, may be off-center within the exhaust conduit to define a longer portion of the valve plate and a shorter portion of the valve plate. The valve plate in the illustrated embodiments has a dimension between the upper and lower arcuate edges that is greater than the inside diameter of the exhaust conduit, such that the valve plate is oriented an angle less than ninety degrees in the closed position. However, it is contemplated that the valve plate in other embodiments may have a shape or dimension that allows it to pivot substantially perpendicular to the flow path. The valve plate may include end portions on opposing sides of a pivotal axis of the valve plate, where the short end portion of the valve plate may contact the bumper element in the close position, such as shown in the embodiment of FIGS. 9-23. The opposing long end portion of the valve plate, such as shown with a lower arcuate edge, may be spaced from the interior surface of the exhaust conduit in the closed position, to prevent contact between the valve plate and the interior surface of the exhaust conduit and allow small amounts of exhaust gases to pass by the valve plate, which, along with the gaps on the outside edges of the valve plate, can have the tendency to reduce flutter of the valve plate.

As illustrated for example herein, the support shaft may extend through the exhaust conduit, with end portions of the support shaft pivotally engaging the axle seats or supports, which may include bushings 132*a* (FIG. 17), on opposing sidewalls of the tubular conduit to assist with providing smooth rotational movement of the support shaft relative to the exhaust conduit. The intermediate portion of the support shaft, between the opposing ends of the internal section may be rigidly coupled with the valve plate, such that rotation or pivoting of the support shaft operates the valve plate between the open and closed positions. The valve plate may also be biased about the pivotal axis to the closed position, such as by an external spring, as shown for example in FIGS. 9-23. However, it is contemplated that a spring or other biasing device may be contained in a housing or otherwise arranged on the interior of the exhaust conduit to similarly bias the valve plate in the closed position.

In the illustrated embodiment shown in FIGS. 9-23, the axle supports 132 may include bushings 132*a* (FIG. 17) that engage between the support shaft 114 and the outward protruding flanges 130 for reducing friction and noise from the rotation of the support shaft 114. The bushings may include one or a combination of metal alloys, such as steel mesh, bronze, iron, ceramics, and composite materials, such as those containing carbon fibers and polymers. The bushings may include a metal wire mesh, a solid sleeve, or a combination of materials to provide a relatively low friction surface for rotation of the support shaft. The bushings may also optionally include metal wire mesh that is coated, compacted, adhered to, or otherwise integrated with a graphite material to provide additional friction resistance against the pivot rod or shaft. Specifically, a graphite powder may be compacted into the pores of the wire mesh before, after, or during the forming process of shaping the wire mesh into the bushing. In additional embodiments, it is contemplated that the axle supports may not include separate bushings or that the bushings may be integrally formed with the axle supports. It is also conceivable that the embossed indentations in other embodiments may be differently shaped and configured to be contained on more or less of the first or second pipe sections.

Figure 23:
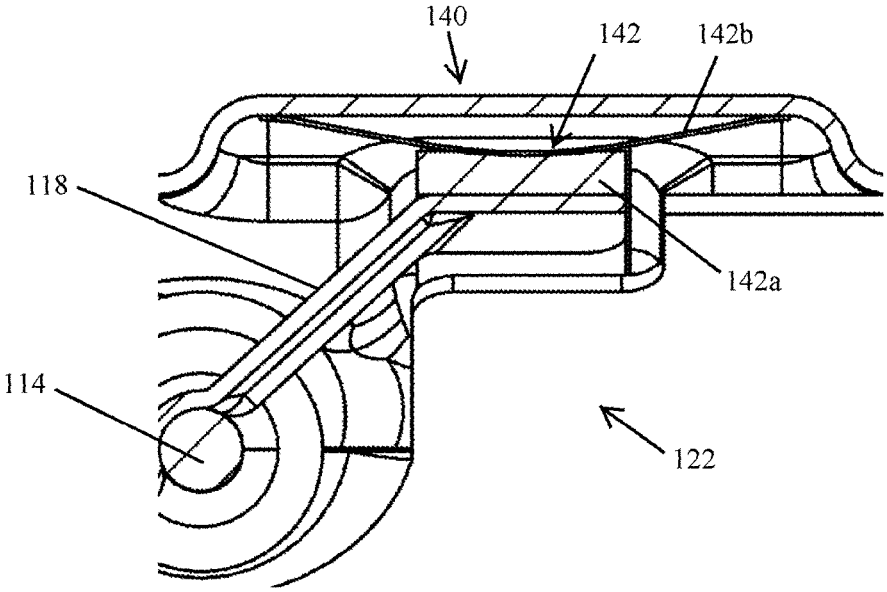
FIG. 23 is an enlarged view of the passive exhaust valve assembly shown in the outlined area designated as section XXIII shown in FIG. 11.

When the valve plate moves toward the closed position, the end portion of the valve plate may contact the bumper element 142 (FIG. 23) to slow and eventually cease pivotal movement of the valve plate in the closed position 122. To facilitate reducing the closure speed of the valve plate, the bumper element may optionally be biased inward and toward the portion of the valve plate 118 that contacts the bumper element. In the illustrated example, the mesh pad 142*a* is resiliently biased inward toward the central axis of the exhaust conduit for the end portion of the valve plate to contact the bumper element as it moves toward the closed position 122 (FIG. 23), and thereby gradually reduces the closure speed of the valve plate to the closed position 122, further attenuating closure noises. The bumper element may be biased with an integral feature, such as a resilient mesh, or with an additional component, such as a spring 142*b*, as shown in FIG. 23. The spring 142*b* is illustrated as a resilient leaf spring, but may be several types of springs, such a coiled compression spring or air spring or the like.

Figure 22:
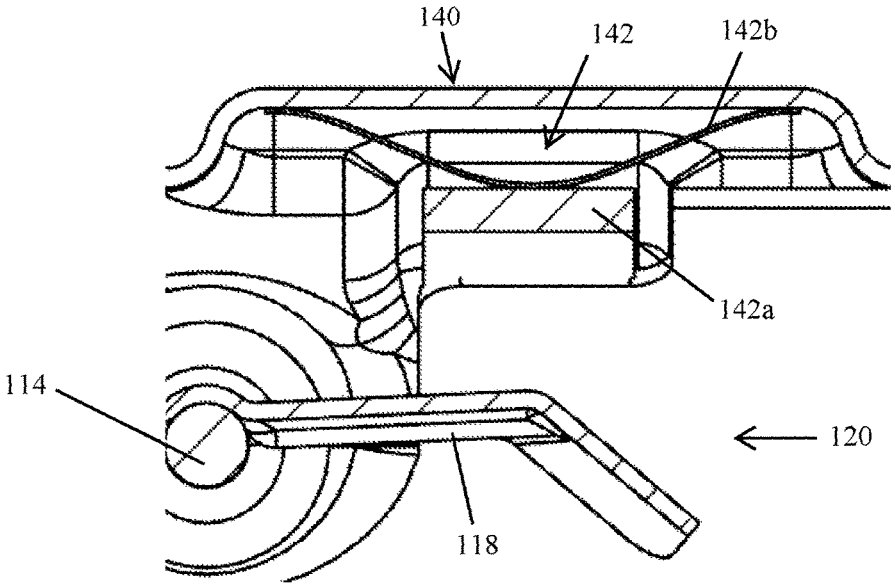
FIG. 22 is an enlarged view of the passive exhaust valve assembly shown in the outlined area designated as section XXII shown in FIG. 19.

As shown in FIGS. 22 and 23, the spring may engage between the recessed pocket 140 on the exhaust conduit and the bumper element 142*a* to bias the bumper element 142 inward and absorb energy from the valve plate moving 118 toward the closed position 122. Specifically, the spring is engaged in the recessed pocket of the exhaust conduit, with the ends of the leaf spring contacting the interior edge portions of the recessed pocket. The illustrated spring is oriented with its elongated extent in generally parallel alignment with the exhaust flow path and an intermediate portion of the spring contacting the mesh pad. As best illustrated in FIGS. 22 and 23, the operation of the spring is shown moving between an extended position (FIG. 22), with the valve plate in the open position or otherwise not in contact with the mesh pad, and a compressed position (FIG. 23), with the valve plate in the closed position and contacting the mesh pad.

Optionally, the bumper element 142*a* may be floating or movably engaged within the recessed pocket 140 of the exhaust conduit to allow for movement of the bumper element relative to the exhaust conduit, such as in a resilient range or distance defined when the valve plate moves between the open position 120 and the closed position 122. However, it is also contemplated that the bumper element 142*a* may also be fixedly coupled with the exhaust conduit, such as by welding or high temperature adhesives. As shown in FIGS. 9-23, the mesh pad 142*a* is oriented generally perpendicular to the exhaust flow path, such that it has a curvature generally corresponding to the curvature of the interior surface of the exhaust conduit. This can also be seen in FIGS. 19 and 21, whereby, in the open position 120, the intermediate portion of the mesh pad 142*a* protrudes inward into the cylindrical shaped interior volume 116 of the exhaust conduit 112, which is facilitated by the inward biasing force of the leaf spring.

Figure 19:
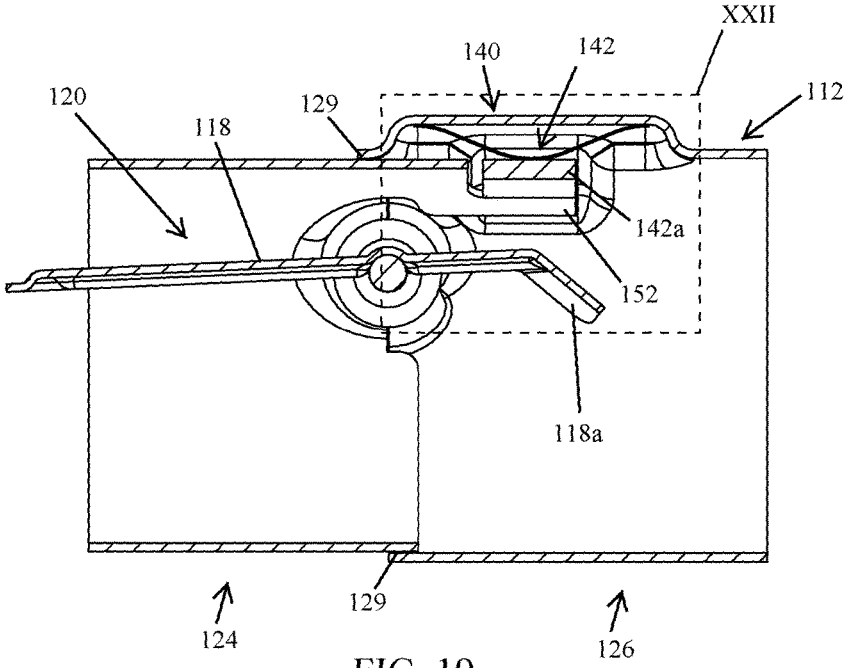
FIG. 19 is a cross-sectional view of the passive exhaust valve assembly shown in FIG. 17, taken at line XIX-XIX of FIG. 20.
Figure 20:
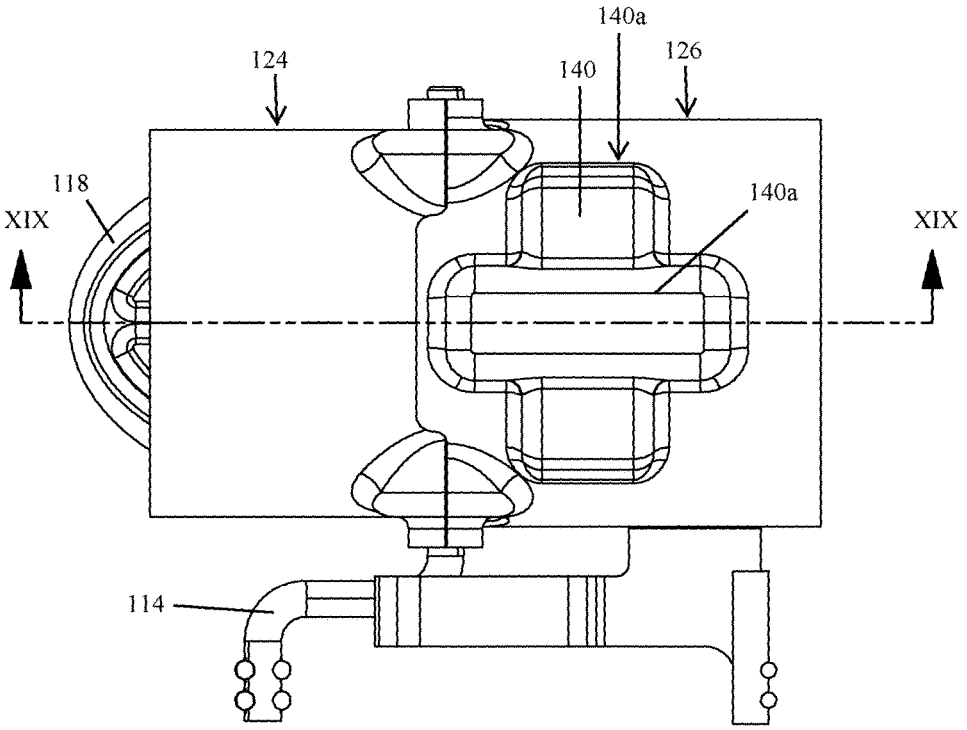
FIG. 20 is a top plan view of the passive exhaust valve assembly shown in FIG. 17.
Figure 21:
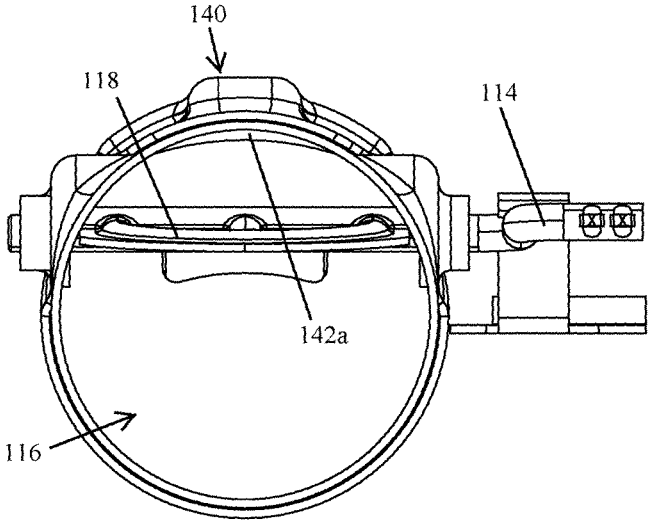
FIG. 21 is an end elevational view of the passive exhaust valve assembly shown in FIG. 17.

The floating or movable engagement of the mesh pad with the exhaust conduit allows the mesh pad to have a greater range of resiliency with the spring. An example of providing such moveable engagement of the mesh pad is by at least one of the end portions of the mesh pad to be loosely or movably engaged in a channel, which can, for example, be provided between overlapping sections of the pipe sections of the exhaust conduit. The recessed pocket, such as shown in FIG. 20, has a longitudinal portion 140*a* for the spring that is depressed away from the exhaust flow path further than a lateral portion 140*b* of the recessed pocket 140 that is provided for the mesh pad 142*a*. As shown in FIG. 19, the lateral portion of the recessed pocket may have the arm 152 or protrusions from the opposing pipe section extending over the edges of the mesh pad 142*a* to provide the channel between the arm 152 and the lateral portion 140*a* of the recessed pocket 140 for movable engagement with the mesh pad 142*a*. Although the mesh pad is shown coupled or contacting to the spring without an attachment interface, it is contemplated that the bumper element may be fixedly attached to the spring.

For the bumper element to contact a greater surface area than the edge of the valve plate would otherwise provide, the first end portion of the valve plate may also include a stop member protruding from a body portion of the valve plate. As illustrated in FIG. 19, the stop member 118*a* is angled from the body portion of the valve plate 118 and shaped to have a curved upper surface, such that the shape and orientation of the stop member 118*a* in the closed position 122 (FIG. 13) may generally align with the curvature of the exhaust conduit. The curved shape of the stop member provides a larger surface area on the upper surface of the stop member to contact the bumper element in the closed position and reduce the associated closure noise.

Optionally, support shaft or axle may have an external section that is configured to stop the valve plate in the open and/or closed positions, such as illustrated in FIGS. 9-23. The external section of the support shaft angles perpendicularly from the internal section of the support shaft and extends adjacent to the exterior surface of the exhaust conduit. A distal end portion of the external section angles again perpendicularly in parallel alignment with the internal section of the support shaft to define a spring attachment point. A tension spring may thereby be secured to the spring attachment point, which may include radial protrusions from the distal end portion on opposing sides of the spring to prevent the spring from sliding laterally and disengaging from the spring attachment point on the spring arm. The external section of the support shaft is thereby shown in FIGS. 9-23 to have an L-shape formed with the distal end portion. It is contemplated, however, that the external section of the pivot rod may be alternatively shaped or angled to otherwise provide a spring attachment point sufficient to attach a tension spring.

Optionally, an opposing end of the tension spring may be attached to a spring anchor that is fixed relative to the exhaust conduit, as shown for example in FIGS. 9-23, such that the tension spring may bias the external section of the support shaft in a direction that rotationally positions the valve plate toward the closed position. The spring anchor may be arranged in several ways on the exhaust conduit, such as a separate feature or integral with another component, such as an integral piece of the cover member, as shown in FIGS. 9-23. The spring anchor may be integrally formed with one of the pipe section or by being separately attached.

To stop rotation of the support shaft at an angle that corresponds with the open position of the valve plate a stop feature may optionally be provided separately or integrally with the exhaust conduit. As illustrated in FIGS. 9-23, the stop feature may include an external tab that angles rearward to an angle that abuts the external section of the support shaft with the valve plate in the open position. The external tab thereby may be configured to abut the external section of the pivot rod in a manner that reduces noise associated with the valve plate moving to the open position. It is contemplated that additional embodiments of the tab may include features for strengthening and increasing rigidity of the stop feature, and further other embodiments of the stop feature may be formed with a multitude of different shapes and configurations for abutting the pivot rod to control the positioning of the valve plate.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

For purposes of this disclosure, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature; may be achieved with the two components (electrical or mechanical) and any additional intermediate members being integrally formed as a single unitary body with one another or with the two components; and may be permanent in nature or may be removable or releasable in nature, unless otherwise stated.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A passive exhaust valve assembly, comprising:

an exhaust conduit having a first pipe section configured to be attached in an axial direction with a second pipe section, the first and second pipe sections each comprising a respective end portion, and the end portion of the first pipe section comprising a circumferential segment;

wherein the circumferential segment is disposed within the end portion of the second pipe section to form a sleeved region in which the circumferential segment is sleeved inside the end portion of the second pipe section;

wherein the end portions of the first and second pipe sections each include a flange protruding radially outward from the respective first and second pipe sections, wherein the flange of the first pipe section is circumferentially spaced from the circumferential segment;

wherein the flanges engage with each other to form an axle seat therebetween;

a support shaft extending laterally across an interior volume of the exhaust conduit and rotatably engaging the axle seat; and a valve plate coupled to the support shaft within the interior volume of the exhaust conduit for moving relative to the exhaust conduit between open and closed positions;

wherein one of the first and second pipe sections includes an interior surface with a recessed pocket, and a flexible bumper element disposed at the recessed pocket in a location that contacts the valve plate and dissipates impact of the valve plate moving to the closed position; and wherein the flexible bumper element is resiliently biased radially inward relative to the exhaust conduit, and wherein the bumper element comprises a metal mesh.

2. The passive exhaust valve assembly of claim 1, wherein the flanges each protrude outward from and extend along a portion of a circumference of the respective first or second pipe section.

3. The passive exhaust valve assembly of claim 1, wherein the end portions of the first and second pipe sections each include a second flange protruding radially outward and engaging with each other to form a second axle seat, and wherein the second axle seat is rotatably engaged by the support shaft across the interior volume of the exhaust conduit from the axle seat.

4. The passive exhaust valve assembly of claim 1, comprising a lap weld disposed along the sleeved region of the first and second pipe sections.

5. The passive exhaust valve assembly of claim 1, wherein the end portion of the first pipe section has an exterior diameter that is less than or generally equal to an interior diameter of the end portion of the second pipe section.

6. The passive exhaust valve assembly of claim 1, further comprising:

a bushing coupled between the axle seat and the support shaft to facilitate axial rotation of the support shaft to move the valve plate between the open and closed positions.

7. A passive exhaust valve assembly, comprising:

an exhaust conduit having a first pipe section attached in axial alignment with a second pipe section, the first and second pipe sections comprising respective end portions;

wherein the end portion of the first pipe section comprises a circumferential segment disposed within the end portion of the second pipe section to form an overlapping interface;

wherein the end portions of the first and second pipe sections each comprise a flange protruding radially outward from the respective first or second pipe section;

wherein the flanges engage with each other to form an axle seat therebetween;

a support shaft extending laterally across an interior volume of the exhaust conduit and rotatably engaging the axle seat;

a valve plate coupled to the support shaft within the interior volume of the exhaust conduit for moving relative to the exhaust conduit between open and closed positions; and a flexible bumper element positioned at an interior surface of one of the first and second pipe sections and arranged so that a portion of the valve plate moves in a radial direction into contact with the flexible bumper element when the valve plate moves to the closed position; and wherein the end portion of the other of the first and second pipe section comprises a tab that extends into the one of the first and second pipe sections to overlap with and support the flexible bumper element at the interior surface.

8. The passive exhaust valve assembly of claim 7, wherein the tab includes a pair of arms that extends longitudinally to support respective edge portions of the flexible bumper element in a manner that allows movement of the flexible bumper element relative to the exhaust conduit.

9. The passive exhaust valve assembly of claim 7, wherein the flexible bumper element is resiliently biased radially inward relative to the exhaust conduit, and wherein the bumper element comprises a metal mesh.

10. A method of assembling of a passive exhaust valve assembly, said method comprising:

providing a first pipe section and a second pipe section, wherein an end portion of the first pipe section is sized to mate by fitting within an end portion of the second pipe section, each end portion defining a circumference;

forming a flange that protrudes radially outward along a portion of the circumference of each end portion of the first and second pipe sections;

wherein forming the flanges comprises:

forming a continuous flange around the circumferences of the end portions of the first and second pipe sections; and bending a circumferential section of each of the continuous flanges back to a diameter in substantial alignment with a longitudinal extent of a main tubular shaped portion of the respective first or second pipe section;

forming a first seat portion on the flange of the first pipe section;

forming a second seat portion on the flange of the second pipe section;

engaging a support shaft in one of the first and second seat portions, wherein the support shaft includes a valve plate attached to an intermediate portion of the support shaft;

inserting the first pipe section within the second pipe section to form an overlapping interface between the end portions of the first and second pipe sections, wherein the circumferential sections of the first and second pipe sections engage to form the overlapping interface;

engaging the first seat portion with the second seat portion to form an axle seat circumferentially around the support shaft, upon inserting the first pipe section within the second pipe section; and welding the overlapping interface to attach the first pipe section to the second pipe section and form an exhaust conduit.

11. The method of claim 10, wherein the overlapping interface includes an exterior surface of the first pipe section abutting an interior surface of the second pipe section.

12. The method of claim 10, further comprising:

cutting the continuous flanges on opposing sides of the first and second seat portions prior to bending the circumferential flanges back to or near the respective original first or second diameter, such that the flanges remain protruding radially outward generally orthogonal to the circumferential sections.

13. The method of claim 10, further comprising:

forming a second flange at the end portions of the first and second pipe sections, wherein the second flanges each protrude radially outward and engage with each other to form a second axle seat, and wherein the second axle seat is rotatably engaged by an opposing end portion of the support shaft across the interior volume of the exhaust conduit from the axle seat.

14. The method of claim 10, further comprising:

inserting a bushing between the axle seat and the support shaft to facilitate rotation of the support shaft to move the valve plate between open and closed positions in the exhaust conduit.

15. The method of claim 10, further comprising:

forming a recessed pocket on an interior surface of the second pipe section that protrudes radially outward from an exhaust flow path that extends axially through the exhaust conduit; and engaging a flexible bumper element in the recessed pocket in a location arranged to contact the valve plate and dissipate impact of the valve plate moving toward a closed position.

16. The method of claim 15, further comprising:

forming a tab at the end portion of the first pipe section that extends to overlap with the recessed pocket on the interior of the second pipe section, wherein the tab supports the flexible bumper element in the recessed pocket.

17. The method of claim 16, wherein the tab includes a pair of arms at the end portion of the first pipe that extend longitudinally to the recessed pocket to support edge portions of the flexible bumper element disposed in the recessed pocket in a manner that allows sliding movement of the flexible bumper element at the edge portions when resiliently flexing into the recessed pocket upon contact with valve plate.

* * * * *